US007126544B2

(12) United States Patent
Liu et al.

(10) Patent No.: US 7,126,544 B2
(45) Date of Patent: Oct. 24, 2006

(54) MICROSTRIP ANTENNA HAVING SLOT STRUCTURE

(75) Inventors: I-Ru Liu, Taipei (TW); Chin-Hua Lu, Taoyuan (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/122,081

(22) Filed: May 5, 2005

(65) Prior Publication Data

US 2005/0253757 A1 Nov. 17, 2005

(30) Foreign Application Priority Data

May 12, 2004 (TW) ..... 93113361 A

(51) Int. Cl.
*H01Q 1/38* (2006.01)

(52) U.S. Cl. ..... 343/700 MS; 343/846

(58) Field of Classification Search ..... 343/700 MS, 343/767, 770, 846, 848, 702
See application file for complete search history.

(56) References Cited

U.S. PATENT DOCUMENTS

| | | | | |
|---|---|---|---|---|
| 6,606,071 | B1 * | 8/2003 | Cheng et al. | 343/767 |
| 6,621,455 | B1 * | 9/2003 | Wang et al. | 343/700 MS |
| 6,906,678 | B1 * | 6/2005 | Chen | 343/795 |
| 6,992,627 | B1 * | 1/2006 | Honda et al. | 343/700 MS |

* cited by examiner

*Primary Examiner*—Hoanganh Le
(74) *Attorney, Agent, or Firm*—Rosenberg, Klein & Lee

(57) ABSTRACT

A microstrip antenna having a slot structure is disclosed for providing a sufficient bandwidth so as to meet the antenna requirements. The microstrip antenna is composed of a base board (such as a printed circuit board) and a microstrip patch radiator having the slot structure, wherein the microstrip patch radiator is formed on the base board. The slot structure is composed of a T-shaped slot, an L-shaped slot and a reversed-L-shaped slot, wherein the L-shaped slot and the reversed-L-shaped slot are mirror-reflected to each other.

21 Claims, 11 Drawing Sheets

MICROSTRIP ANTENNA HAVING SLOT STRUCTURE

RELATED APPLICATIONS

The present application is based on, and claims priority from, Taiwan Application Serial Number 93113361, filed May 12, 2004, the disclosure of which is hereby incorporated by reference herein in its entirety.

FIELD OF THE INVENTION

The present invention relates to a microstrip antenna having a slot structure, and more particularly, to the microstrip antenna providing a sufficient bandwidth with a symmetrical slot structure.

BACKGROUND OF THE INVENTION

With the advancement of communication technologies, various communication products and technologies have been continuously appearing in the market. Moreover, with integrated circuit (IC) technologies getting matured, the size of product has been gradually developed toward smallness, thinness, shortness and lightness. With respect to an antenna used for radiating or receiving signals in the communication products, the size of the antenna determines if the objective of smallness, thinness, shortness and lightness can be achieved.

An antenna is an element used for radiating or receiving electromagnetic wave, and generally, the features of antenna can be known by the parameters of operation frequency, radiation patterns, reflected loss, and antenna gain, etc. The antennas used in the present wireless communication products must have the advantages of small size, excellent performance and low cost, so as to be popularly accepted and approved by the market. According to different operation requirements, the functions equipped in the communication products are not all the same, and thus there are many varieties of antenna designs used for radiating or receiving signals, such as a rhombic antenna, a turnstile antenna, a microstrip antenna, and an inverted-F antenna, etc., wherein the microstrip antenna has the advantages of small size, light weight, easy fabrication, flexibly forming on a curved surface and being able to form with other electric elements in the same circuit, etc. The conventional microstrip patch antenna's radiating portion (microstrip patch) is about ½ wavelength (λ) long. Therefore, it is an important issue about how to further shrink the size of the microstrip patch antenna.

On the other hand, due to increasing demands of high-speed wireless communication, many new technologies have been continuously adopted in the actual applications, wherein ultra wideband (UWB) is one of the technologies under vigorous development. UWB is a wireless transmission specification using quite a broad bandwidth. The Federal Communications Commission (FCC) regulates that the frequency UWB is ranged in the bandwidth smaller than 1 GHz and the bandwidth between 3.1 GHz and 10.6 GHz, and the bandwidth of UWB can be as large as 500 MHz. However, the bandwidth of the conventional microstrip antenna is too small to meet the requirements of UWB.

Hence, there is an urgent need to develop a microstrip antenna for further reducing the antenna size and providing sufficient bandwidth for overcoming the shortcoming of the conventional technology.

SUMMARY OF THE INVENTION

An aspect of the present invention is to provide a microstrip antenna having a slot structure, thereby reducing antenna size and fabrication cost.

The other aspect of the present invention is to provide a microstrip antenna having a slot structure, thereby providing sufficient bandwidth so as to meet the requirements of UWB.

According to the aforementioned aspects, the present invention provides a mircostrip antenna having a slot structure, which has sufficient bandwidth meeting the requirements of UWB.

According to a preferred embodiment of the present invention, the microstrip antenna having a slot structure comprises a base board and a microstrip patch radiator, wherein the base board has a first surface and a second surface, and the first surface is parallel to the second surface. The microstrip patch radiator is formed on the first surface of the base board, and the microstrip patch radiator has the slot structure exposing a portion of the base board. The slot structure has a T-shaped slot, an L-shaped slot and a reversed-L-shaped slot. The T-shaped slot is composed of a first linear slot and a second linear slot, and the first linear slot is vertical to a side of the microstrip patch radiator, and vertically connects the side to a middle position of the second linear slot. One end of the L-shaped slot is vertically connected to one end of the second linear slot, and the opening direction of the L-shaped slot faces towards the first linear slot. One end of the reversed-L-shaped slot is vertically connected to the other end of the second linear slot, and the opening direction of the reversed-L-shaped slot faces towards the first linear slot.

Further, the microstrip antenna comprises a ground plane, wherein the ground plane is located on the second surface of the base board.

Hence, with the use of the present invention, the antenna size can be greatly reduced and the fabrication cost can be greatly lowered; sufficient bandwidth can be effectively provided for meeting the requirements of UWB.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
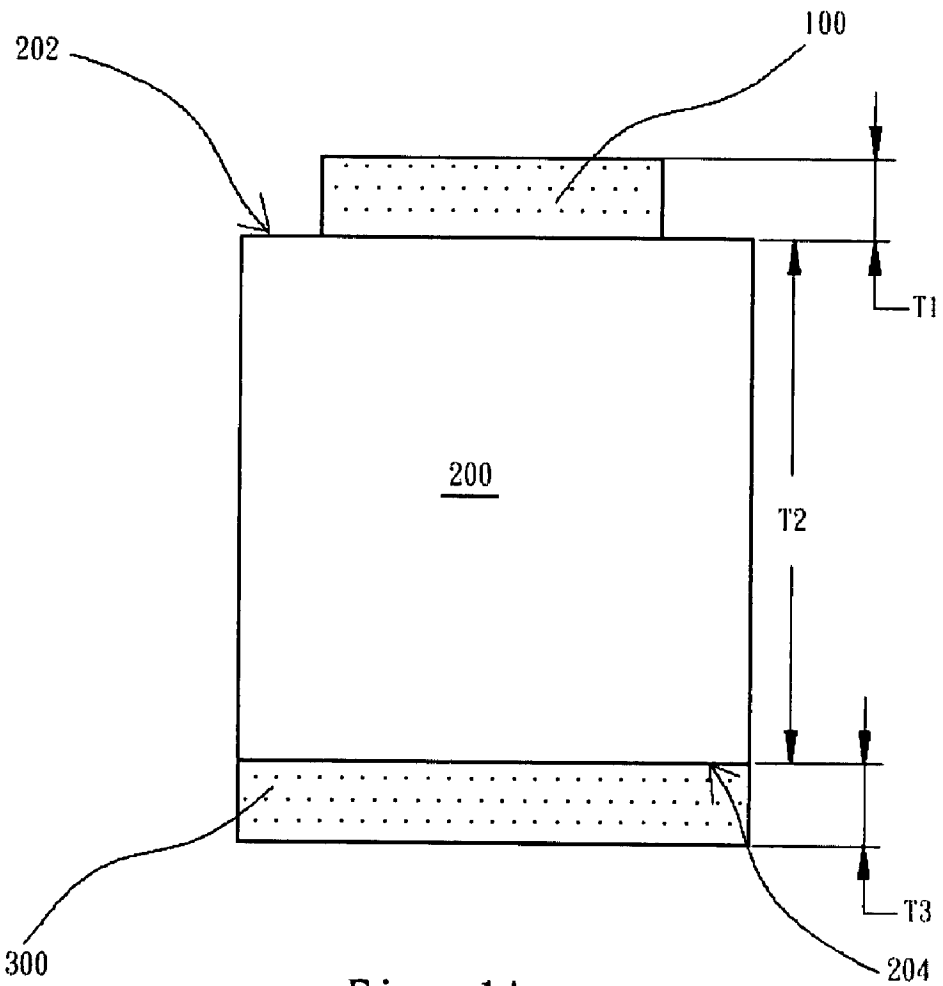
FIG. 1A is a schematic side view showing a microstrip antenna having a slot structure according to a first preferred embodiment of the present invention.
Figure 1B:
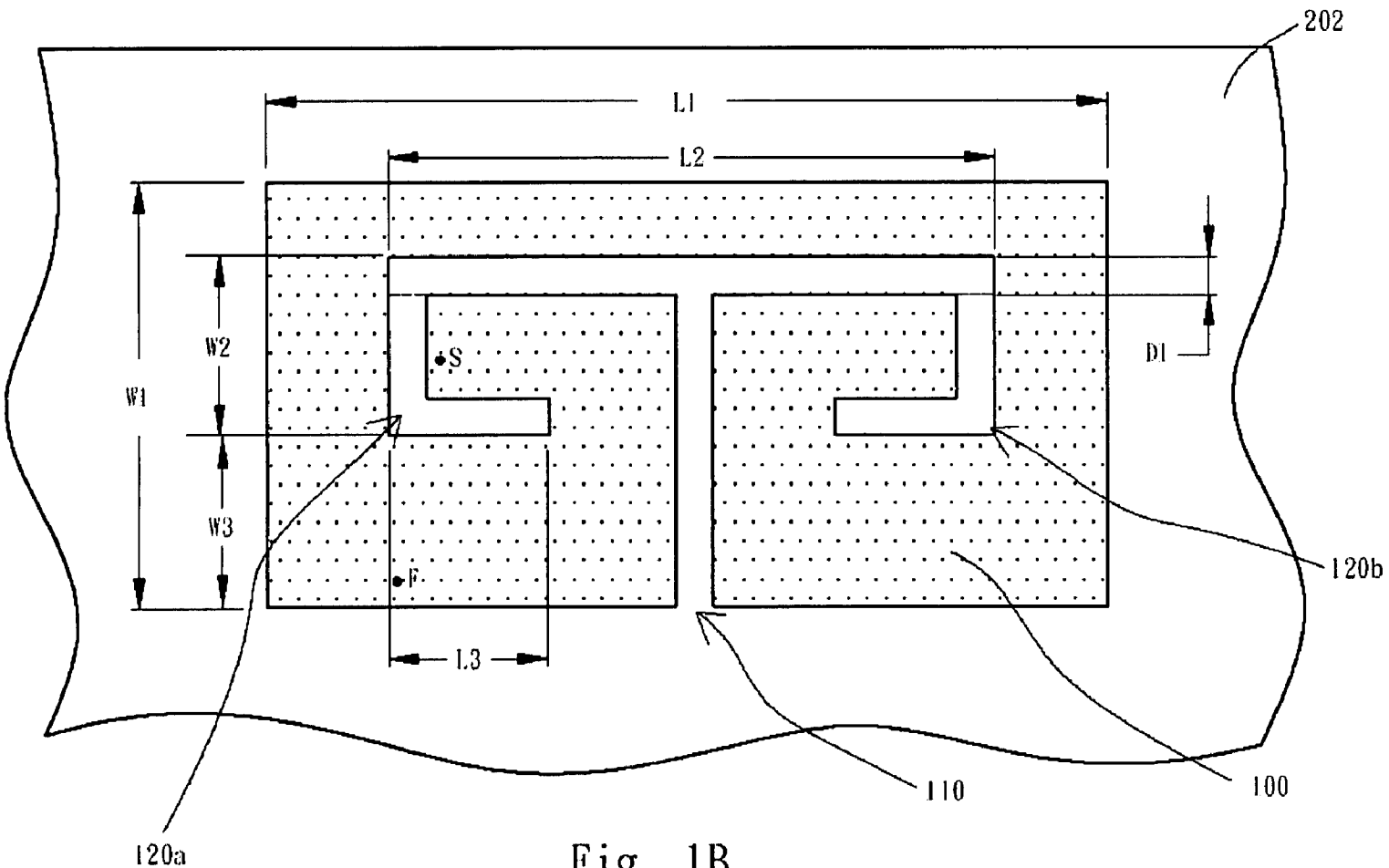
FIG. 1B is a schematic top view of the microstrip antenna having the slot structure according to the first preferred embodiment of the present invention.

Referring to FIG. 1A and FIG. 1B, FIG. 1A and FIG. 1B are respective schematic side and top views of a microstrip antenna having a slot structure according to a first preferred embodiment of the present invention. Such as shown in FIG. 1A, a base board 200 (for example: a printed circuit board) has a first surface 202 and a second surface 204, and the first surface 202 is parallel to the second surface 204. A microstrip patch radiator 100 (for example: a rectangle) is formed on the first surface 202 of the base board 200, and ground plane 300 is formed on the second surface 204 of the base board 200, wherein the ground plane 300 may cover part or all of the second surface 204. The base board 200 can be a printed circuit board made of glass fiber material (such as FR4) or other materials, and the microstrip patch radiator 100 and the ground plane 300 are made of metal material.

Such as shown in FIG. 1B, the microstrip patch radiator 100 has a slot structure (not labeled), and the slot structure exposes a portion of the first surface 202 of the base board 200. The slot structure is composed of a T-shaped slot 110 (up to the dotted line shown), an L-shaped slot 120*a* and a reversed-L-shaped slot 120*b*, wherein the L-shaped slot 120*a* and the reversed-L-shaped slot 120*b* are mirror-reflected to each other. The T-shaped slot 110 is composed of a first linear slot (the vertical part) and a second linear slot (the horizontal part), wherein the first linear slot is vertical to a side (such as a longer side of the rectangle) of the microstrip patch radiator 100, and vertically connects the side to a middle position of the second linear slot. One end of the L-shaped slot 120*a* is vertically connected to one end of the second linear slot, wherein the opening direction of the L-shaped slot 120*a* faces towards the first linear slot. One end of the reversed-L-shaped slot 120*b* is vertically connected to the other end of the second linear slot, wherein the opening direction of the reversed-L-shaped slot 120*b* faces towards the first linear slot, i.e. the opening direction of the reversed-L-shaped slot 120*b* is opposite to that of the L-shaped slot 120*a*. A short point S is located on the microstrip patch radiator 100 inside the angled shape of the L-shaped slot 120*a*, wherein the short point S is electrically connected to the ground plane 300 (such as shown in FIG. 1A) through the base board 200.

Based on the symmetry principle, the short point S also can be located at the inner side of the reversed-L-shaped slot 120*b*, or at the side of the T-shaped slot 110 near the reversed-L-shaped slot 120*b*, i.e. on the microstrip patch radiator 100 inside the angled shape of the reversed-L-shaped slot 120*b*.

A feed point F is located at a position below the connection end between the L-shaped slot 120*a* and the T-shaped slot 110; and adjacent to the side of the microstrip patch radiator 100 connected to the first linear slot.

The feeding method of the present invention can be the method of directly feeding to the feed point F of the microstrip patch radiator 100; that of using a cylindrical probe connecting the feed point F to a coaxial connector located on the ground plane 300; that of using a cylindrical probe connecting the feed point F to a coplanar waveguide (CPW) located on the ground plane 300, etc.

Further, such as shown in FIG. 1A, according to the first preferred embodiment, the thickness T1 of the microstrip patch radiator 100 is about 0.043 mm; the thickness T2 of the base board 200 is about 1.524 mm; and the thickness T3 of the ground plane 300 is about 0.043 mm. Such as shown in FIG. 1B, the length L1 of the microstrip patch radiator 100 is about 18 mm; and the width W1 of the microstrip patch radiator 100 is about 10.5 mm. The length L2 of the second linear slot is about 12.5 mm. The distance W3 between the bottom side of the L-shaped slot 120*a* or the reversed-L-shaped slot 120*b* and the side of the microstrip patch radiator 100 is about 4.25 mm, and the distance W2 between the bottom side of the L-shaped slot 120*a* or the reversed-L-shaped slot 120*b* and the second linear slot is about 3.5 mm, and the width D1 of the slot structure is about 0.5 mm, so that the length (W2+W3−D1) of the first linear slot is about 7.25 mm. The length L3 of the bottom side of the L-shaped slot 120*a* or the reversed-L-shaped slot 120*b* is about 3 mm, and the distance between the short point S and the bottom side of the L-shaped slot 120*a* is about 1.25 mm, and the distance between the feed point F and the left side (labeled with W3) of the microstrip patch radiator 100 is about 3 mm.

The microstrip antenna with the slot structure of the present invention can be formed by directly using the microstrip radiating element of the specific shape shown in FIG. 1B, or by respectively forming the T-shaped slot 110, the L-shaped slot 120*a* and the reversed-L-shaped slot 120*b* on a rectangular patch radiator. It can be known from the aforementioned specification, fabrication material and method, the first preferred embodiment of the present invention has the advantages of small size and low fabrication cost.

The positions of the short point S and feed point F, and the size and shape of the microstrip antenna described above are merely stated as examples for explanation, and the present invention is not limited thereto.

Figure 2:
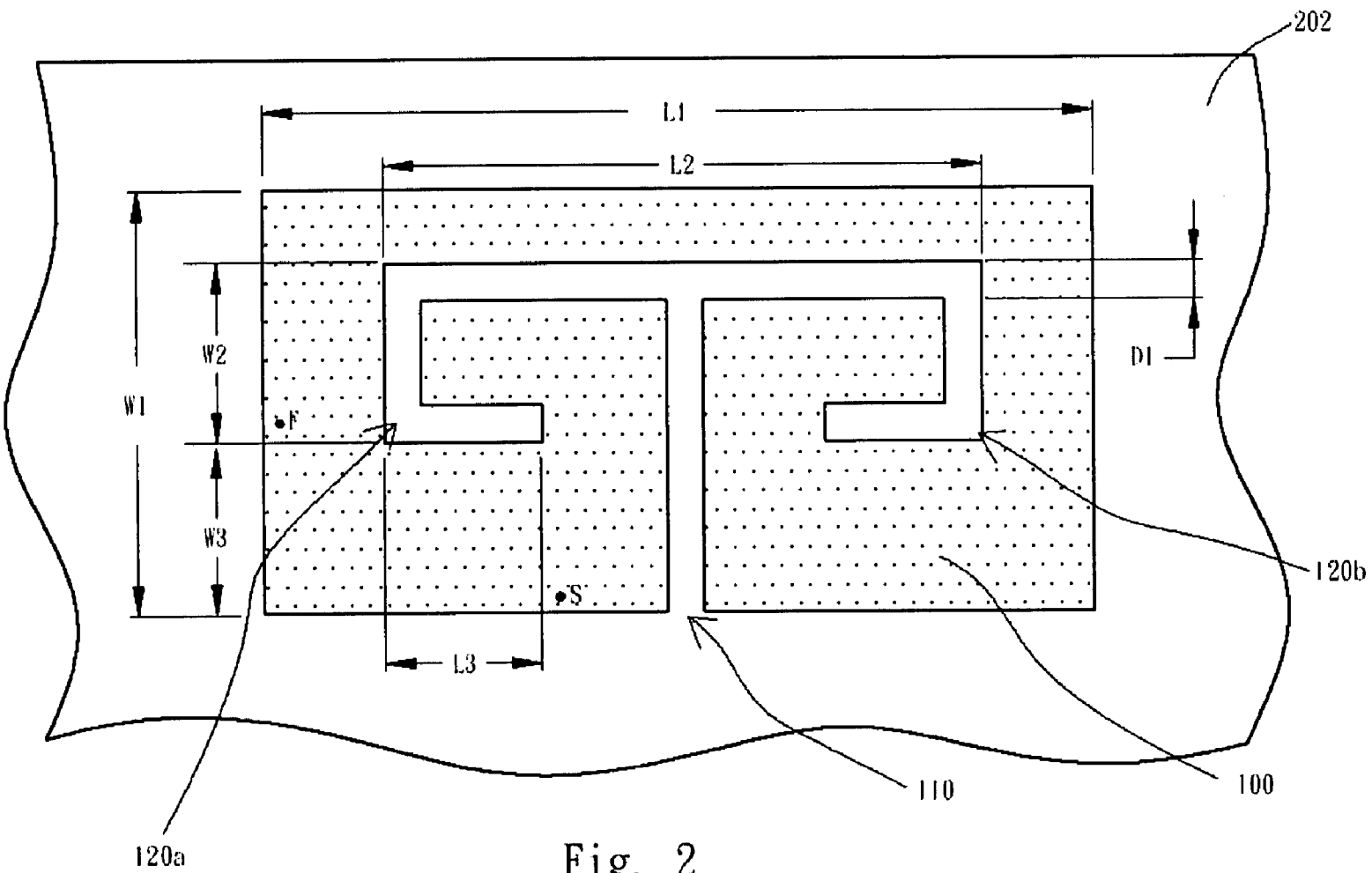
FIG. 2 is a schematic top view of a microstrip antenna having a slot structure according to a second preferred embodiment of the present invention.

Referring FIG. 2, FIG. 2 is a schematic top view of a microstrip antenna having a slot structure according to a second preferred embodiment of the present invention. The positions of the short point S and feed point F are different between the first preferred embodiment and the second preferred embodiment, and so is the size of the microstrip antenna. According to the second preferred embodiment of the present invention, the feed point F is adjacent to the left side (labeled with W3) of the microstrip patch radiator 100, and is spaced from the side of the microstrip patch radiator 100 connected to the first linear slot at a distance of about 4.75 mm. The short point S is adjacent to the aforementioned side, and is spaced from the left side of the microstrip patch radiator 100 at a distance of about 5 mm.

Further, according to the second preferred embodiment, the length L1 of the microstrip patch radiator 100 is about 12 mm; and the width W1 of the microstrip patch radiator 100 is about 9 mm. The length L2 of the second linear slot is about 12 mm. The distance W3 between the bottom side of the L-shaped slot 120*a* or the reversed-L-shaped slot 120*b* and the side of the microstrip patch radiator 100 is about 4.75 mm, and the distance W2 between the bottom side of the L-shaped slot 120*a* or the reversed-L-shaped slot 120*b* and the second linear slot is about 2.5 mm, and the width D1 of the slot structure is about 0.5 mm, so that the length (W2+W3−D1) of the first linear slot is about 6.75 mm. The length L3 of the bottom side of the L-shaped slot 120*a* or the reversed-L-shaped slot 120*b* is about 3 mm, and the distance between the short point S and the bottom side of the L-shaped slot 120*a* is about 1.75 mm. It can be known from the above specification that the actual size of the microstrip antenna in the second preferred embodiment can be further reduced.

To sum up, the ratio between the length L2 of the second linear slot and the length L1 of the microstrip patch radiator 100 is between about 0.5 and about 0.7. The ratio between the length (W2+W3) of the first linear slot and the width W1 of the microstrip patch radiator 100 is between about 0.6 and about 0.8. The ratio between the length (W2−D1) of the L-shaped slot 120*a* or the reversed-L-shaped slot 120*b* parallel to the first linear slot, and the length (W2+W3) of the first linear slot is between about 0.25 and about 0.5. The ratio between the length L3 of the L-shaped slot 120*a* or the reversed-L-shaped slot 120*b* parallel to the second linear slot, and the length L2 of the second linear slot is between about 0.2 and about 0.3. The width of the slot structure is between about 0.3 m and about 1.1 mm.

Figure 3:
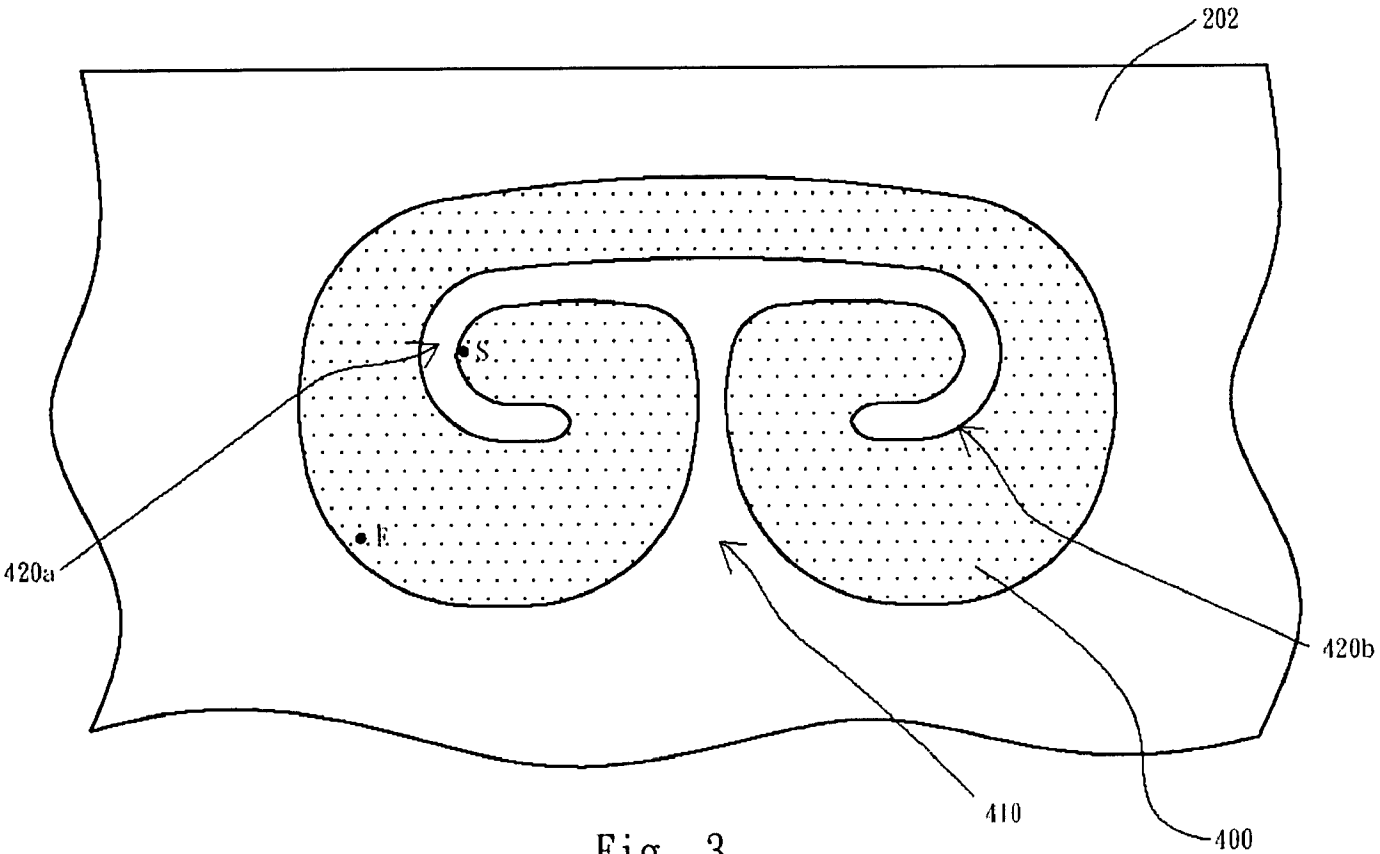
FIG. 3 is a schematic top view of a microstrip antenna having a slot structure according to a third preferred embodiment of the present invention.

Further, referring to FIG. 3, FIG. 3 is a schematic top view of a microstrip antenna having a slot structure according to a third preferred embodiment of the present invention, wherein the microstrip antenna of the third preferred embodiment appears in the shape of twin-spirals (C-shapes formed from arc lines) or one of the patterns of the so-called Cloud-Thunder-Ripples (Yun-Lei-Wen) which first appeared on the Bronze in ancient China, i.e. both the slot structure and the microstrip patch radiator 400 are composed of arc lines. A microstrip patch radiator 400 located on the second surface 202 has an arc-line shape, wherein its slot structure is composed of a substantial T-shaped slot 410, a first hook-shaped slot 420*a* and a second hook-shaped slot 420*b*, and the first hook-shaped slot 420*a* and the second hook-shaped slot 420*b* are mirror-reflected to each other. The substantial T-shaped slot 410 is composed of a first arc slot (the vertical part) and a second arc slot (the horizontal part), wherein the first arc slot is substantially vertical to a side of said microstrip patch radiator 400, and vertically connects the side to a middle position of the second arc slot. One end of the first hook-shaped slot 420*a* is vertically connected to one end of the second arc slot, and the opening direction of the first hook-shaped slot 420*a* faces towards the first arc slot. One end of the second hook-shaped slot 420*b* is vertically connected to the other end of the second arc slot, and the opening direction of the second hook-shaped slot 420*b* faces towards the first arc slot. Further, a short point S can be located on the microstrip patch radiator 400 inside the hook shape of the first hook-shaped slot 420*a* or that of the second hook-shaped slot 420*b*. A feed point F can be located on the same side with the first hook-shaped slot 420*a* with respect to the substantial T-shaped slot 410; and adjacent to the side of the microstrip patch radiator 400 connected to the first arc slot. Just as described in the first preferred embodiment, a ground plane (not shown) of the third embodiment can be formed on the second surface (not shown) of the base board (not shown) opposite to the first surface 202, and the short point is electrically connected to the ground plane through the base board.

Figure 4A:
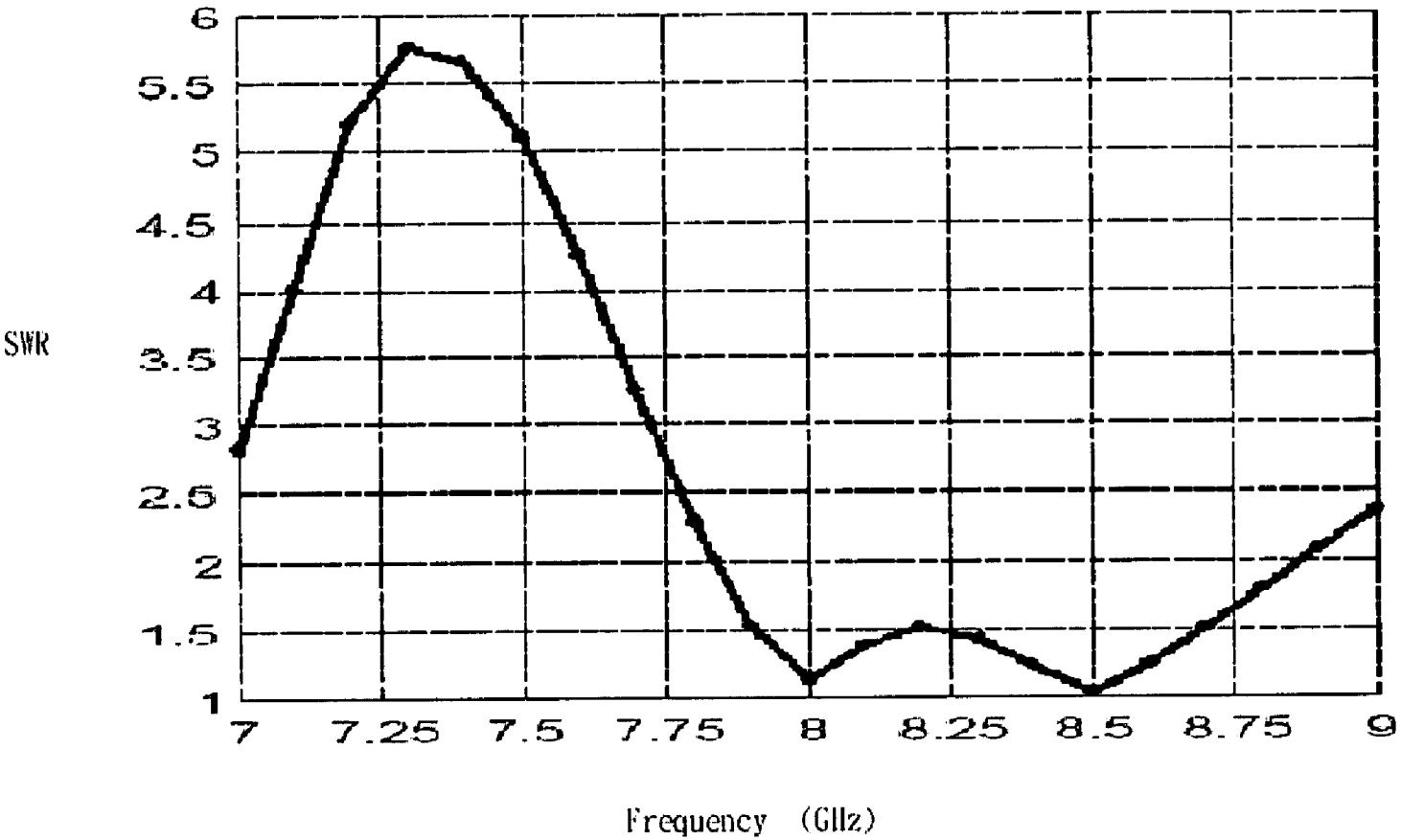
FIG. 4A is a diagram showing a measured curve of SWR (Standing Wave Ratio) vs. frequency for the microstrip antenna having the slot structure, according to the first preferred embodiment of the present invention.
Figure 4B:
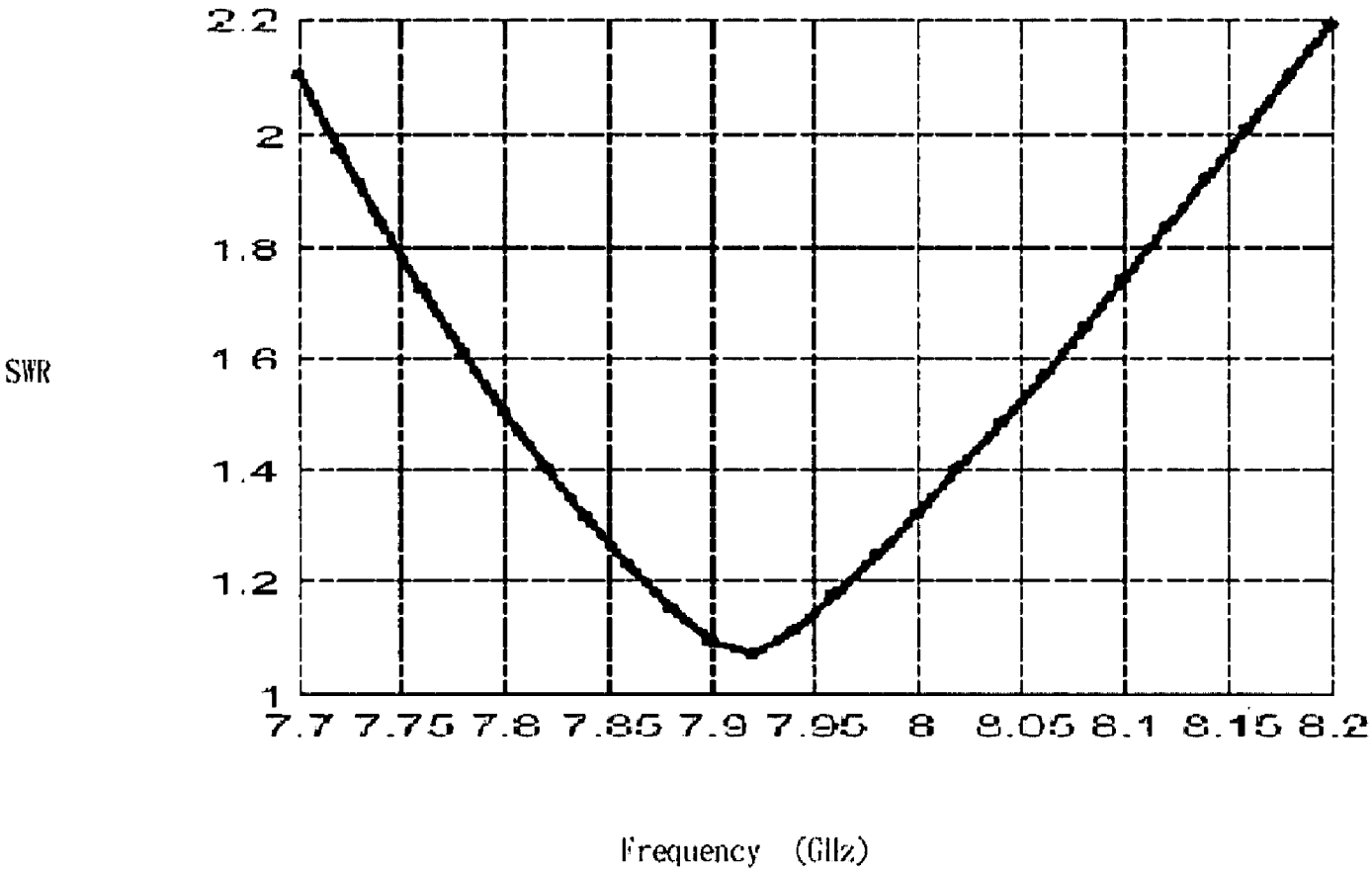
FIG. 4B is a diagram showing a measured curve of SWR vs. frequency for the microstrip antenna having the slot structure, according to the second preferred embodiment of the present invention.

Moreover, the microstrip antenna of the present invention has quite excellent antenna features. Referring to FIG. 4A, FIG. 4A is a diagram showing a measured curve of SWR (voltage standing wave ratio) vs. frequency for the microstrip antenna having the slot structure, according to the first preferred embodiment of the present invention. When the microstrip antenna of the first preferred embodiment is operated at about 8.5 GHz, the SWR is about 1:1.02. With the reference SWR of about 1:1.8 and the central frequency of about 8.3 GHz, the microstrip antenna of the first preferred embodiment can provide the bandwidth of about 1000 MHz. Further, referring to FIG. 4B, FIG. 4B is a diagram showing a measured curve of SWR vs. frequency, according to the second preferred embodiment of the present invention. When the microstrip antenna of the second preferred embodiment is operated at about 7.92 GHz, the SWR is about 1:1.07. With the reference SWR of about 1:1.8 and the central frequency of about 7.94 GHz, the microstrip antenna of the second preferred embodiment can provide the bandwidth of about 400 MHz. Thus, the microstrip antennas of the first and second preferred embodiment can meet UWB requirements.

Figure 5A:
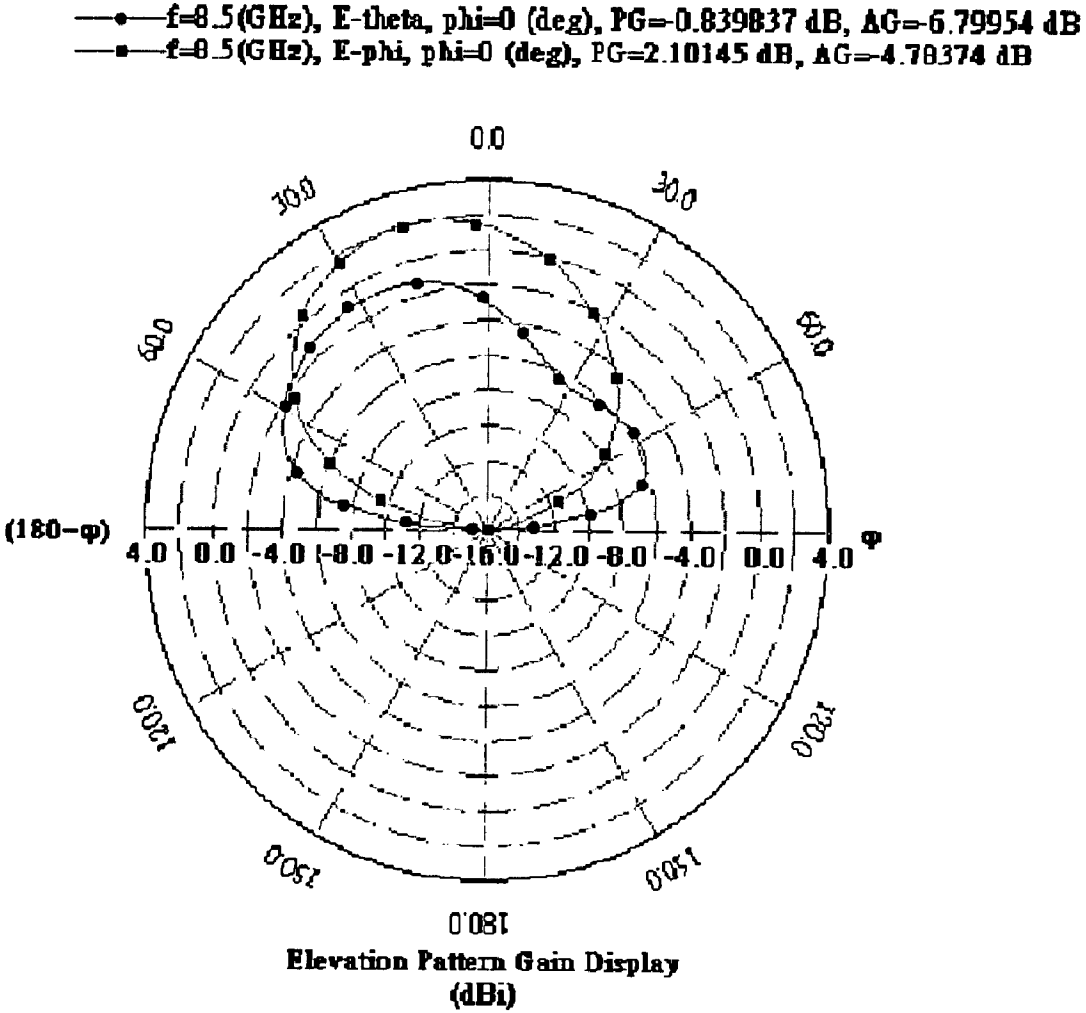
FIG. 5A is a diagram showing an elevation radiation pattern when the microstrip antenna of the first preferred embodiment is operated at 8.5 GHz, wherein Φ=0°.
Figure 5B:
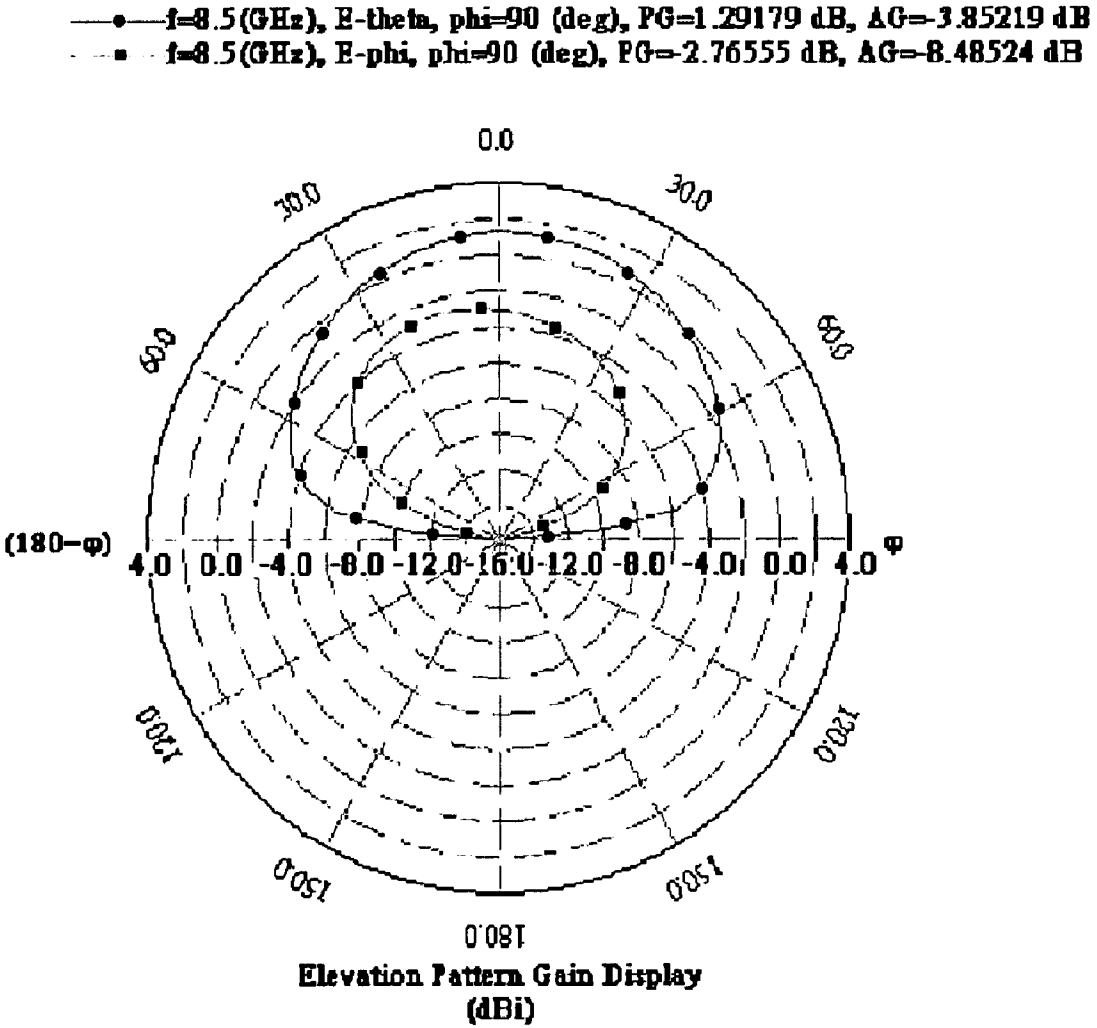
FIG. 5B is a diagram showing an elevation radiation pattern when the microstrip antenna of the first preferred embodiment is operated at 8.5 GHz, wherein Φ=90°.
Figure 6A:
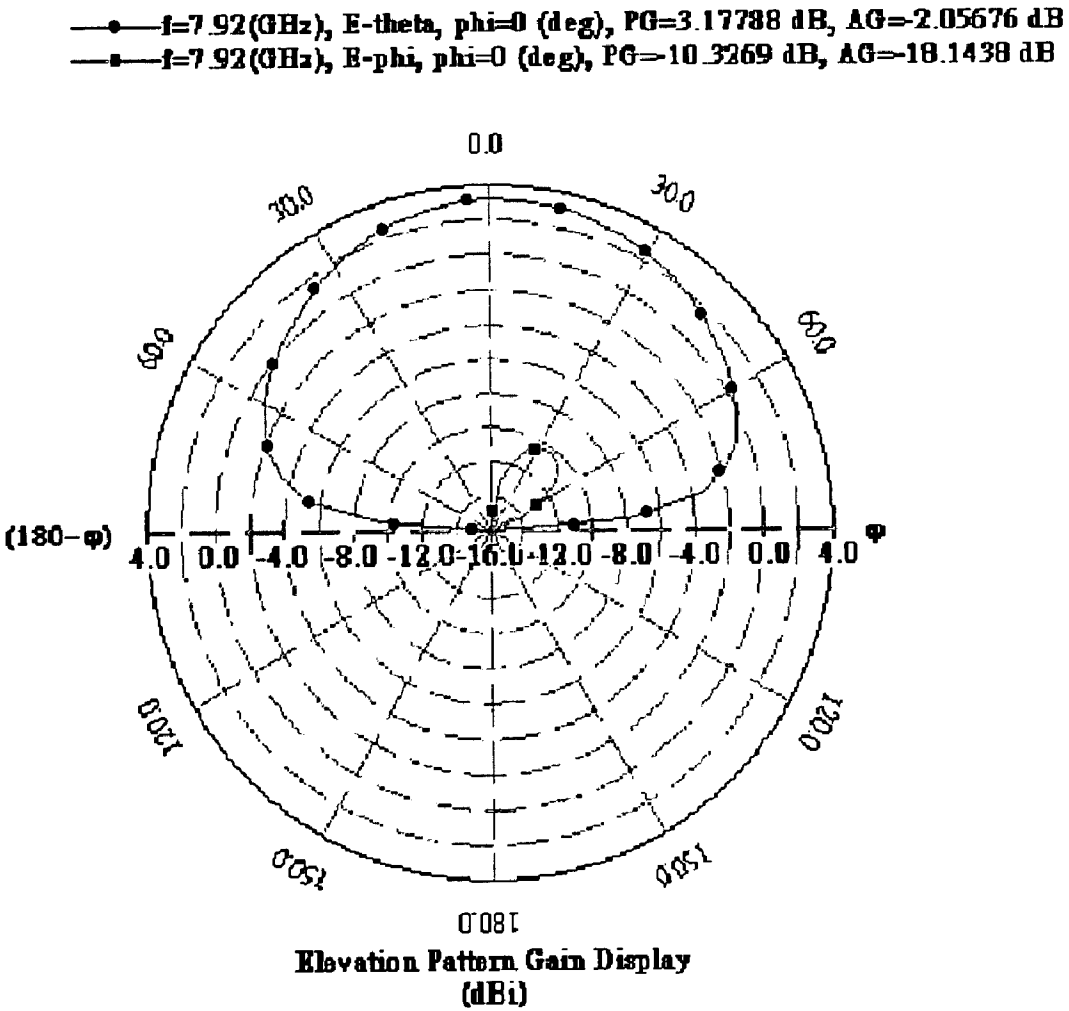
FIG. 6A is a diagram showing an elevation radiation pattern when the microstrip antenna of the second preferred embodiment is operated at 7.92 GHz, wherein Φ=0°.
Figure 6B:
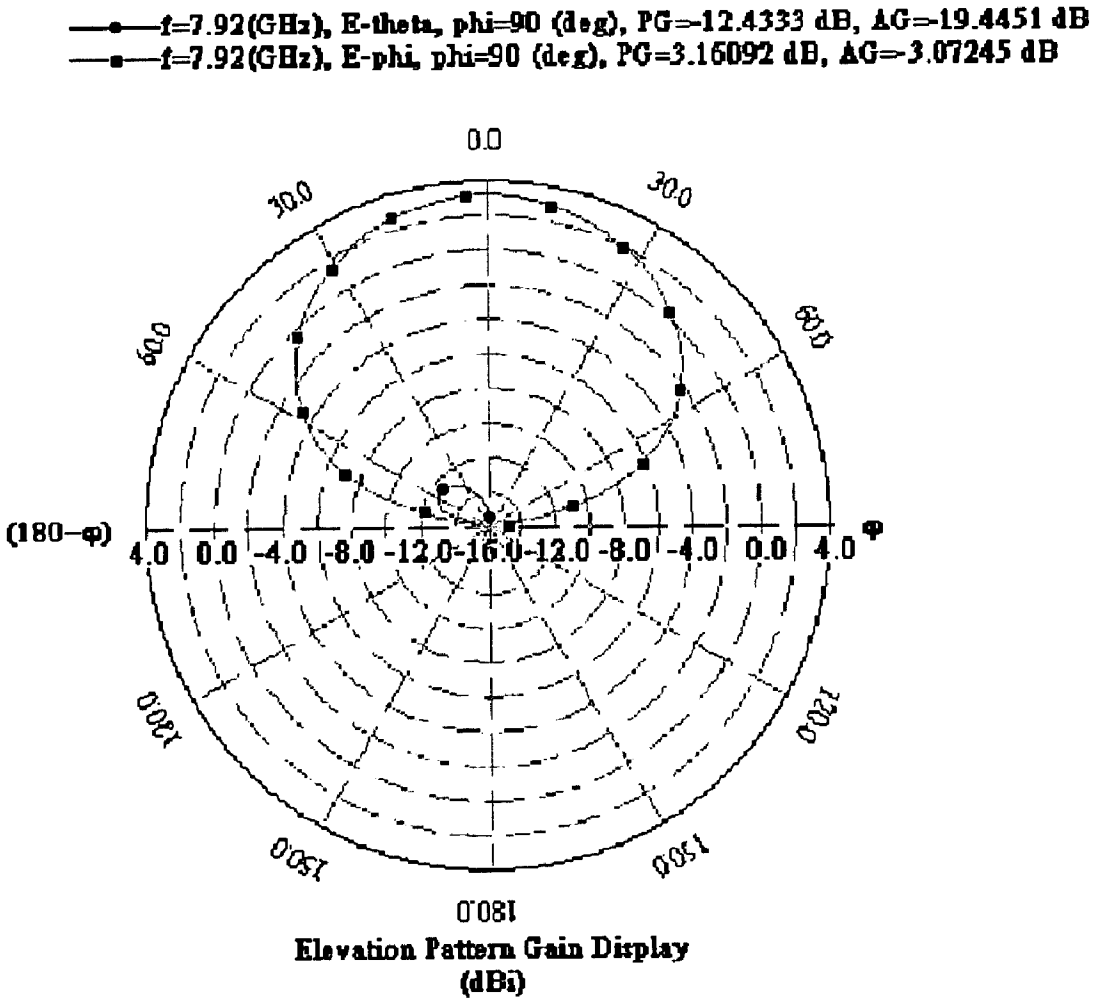
FIG. 6B is a diagram showing an elevation radiation pattern when the microstrip antenna of the second preferred embodiment is operated at 7.92 GHz, wherein Φ=90°.
Figure 6C:
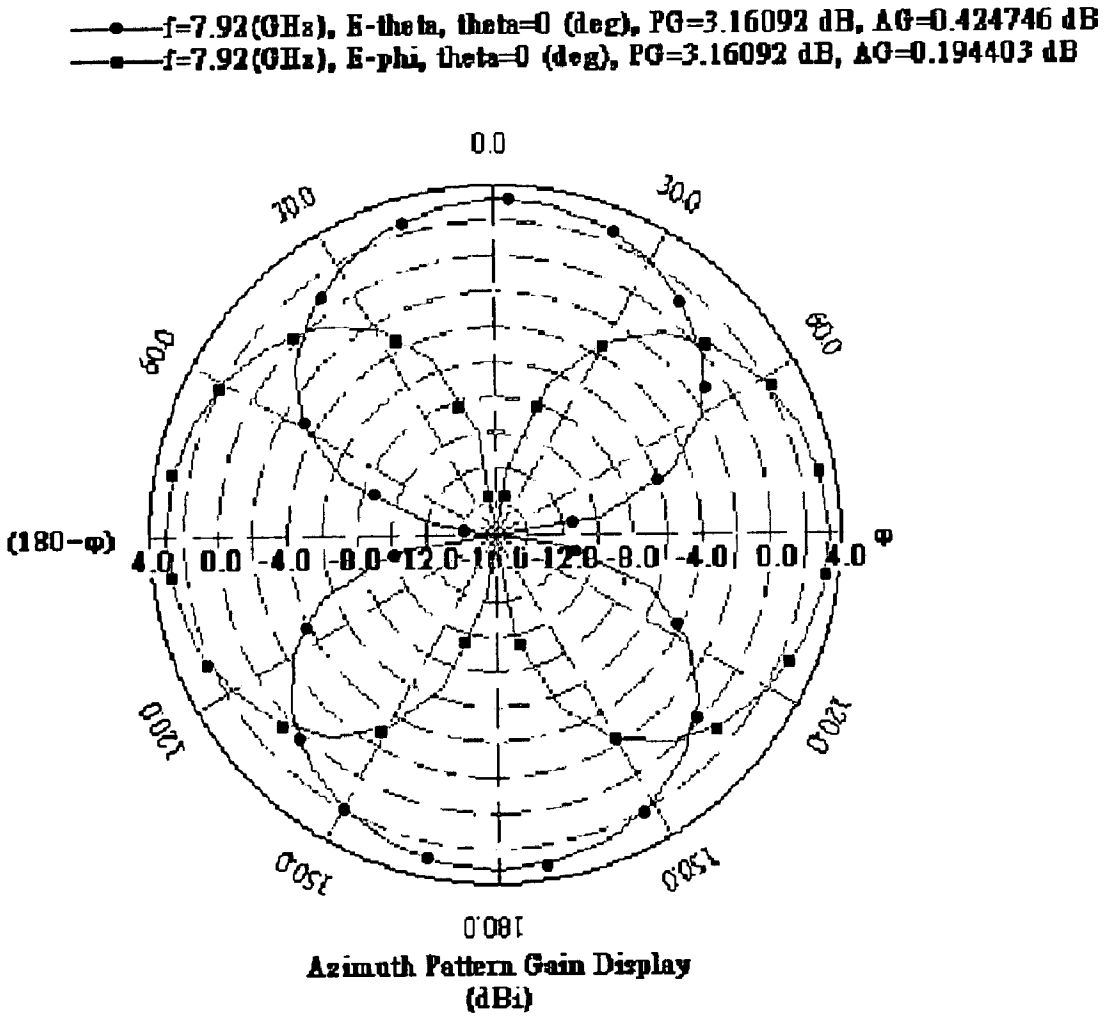
FIG. 6C is a diagram showing an azimuth radiation pattern when the microstrip antenna of the second preferred embodiment is operated at 7.92 GHz, wherein θ=0°.

Referring to FIG. 5A and FIG. 5B, FIG. 5A is a diagram showing an elevation radiation pattern when the microstrip antenna of the first preferred embodiment is operated at 8.5 GHz, wherein $\Phi=0°$; and FIG. 5B is a diagram showing an elevation radiation pattern when the microstrip antenna of the first preferred embodiment is operated at 8.5 GHz, wherein $\Phi=90°$. Accordingly, it can be known from FIG. 5A and FIG. 5B that the microstrip antennas of the first preferred embodiment demonstrates excellent directional radiation patterns, thus sufficiently satisfying user requirements. Further, referring to FIG. 6A to FIG. 6C, FIG. 6A is a diagram showing an elevation radiation pattern when the microstrip antenna of the second preferred embodiment is operated at 7.92 GHz, wherein $\Phi=0°$; FIG. 6B is a diagram showing an elevation radiation pattern when the microstrip antenna of the second preferred embodiment is operated at 7.92 GHz, wherein $\Phi=90°$; and FIG. 6C is a diagram showing an azimuth radiation pattern when the microstrip antenna of the second preferred embodiment is operated at 7.92 GHz, wherein $\theta=0°$. Accordingly, it can be known from FIG. 6A to FIG. 6C that the microstrip antennas of the second preferred embodiment demonstrates excellent directional radiation patterns, thus sufficiently satisfying user requirements.

Just as described in the aforementioned preferred embodiments of the present invention, the application of the present invention has the advantages of greatly reducing the antenna and fabrication cost; and effectively providing sufficient bandwidth for meeting the requirements of UWB.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A microstrip antenna having a slot structure, said microstrip antenna comprising:

a base board having a first surface and a second surface, wherein said first surface is parallel to said second surface; and a microstrip patch radiator formed on said first surface of said base board, wherein said microstrip patch radiator has said slot structure exposing a portion of said base board, said slot structure having:

a T-shaped slot composed of a first linear slot and a second linear slot, wherein said first linear slot is vertical to a side of said microstrip patch radiator, and vertically connects said side to a middle position of said second linear slot;

an L-shaped slot, wherein one end of said L-shaped slot is vertically connected to one end of said second linear slot, and the opening direction of said L-shaped slot faces towards said first linear slot; and a reversed-L-shaped slot, wherein one end of said reversed-L-shaped slot is vertically connected to the other end of said second linear slot, and the opening direction of said reversed-L-shaped slot faces towards said first linear slot, and said L-shaped slot and said reversed-L-shaped slot are mirror-reflected to each other.

2. The micro strip antenna of claim 1, further comprising:

a ground plane located on said second surface of said base board.

3. The microstrip antenna of claim 2, further having:

a short point located on said micro strip patch radiator inside the angled shape of said L-shaped slot or the angled shape of said reversed-L- shaped slot, wherein said short point is electrically connected to said ground plane through said base board.

4. The microstrip antenna of claim 2, wherein said microstrip patch radiator and said ground plane are made of metal material.

5. The microstrip antenna of claim 1, wherein the shape of said microstrip patch radiator is a rectangle.

6. The microstrip antenna of claim 5, wherein said side of said micro strip patch radiator is a longer side of said rectangle.

7. The microstrip antenna of claim 6, wherein the ratio between the length of said second linear slot and the length of said longer side of said rectangle is substantially between 0.5 and 0.7.

8. The microstrip antenna of claim 5, wherein the ratio between the length of said first linear slot and the length of a shorter side of said rectangle is substantially between 0.6 and 0.8.

9. The microstrip antenna of claim 1, wherein the ratio between the length of said L-shaped slot or said reversed-L-shaped slot parallel to said first linear slot, and the length of said first linear slot is substantially between 0.25 and 0.5.

10. The microstrip antenna of claim 1, wherein the ratio between the length of said L-shaped slot or said reversed-L-shaped slot parallel to said second linear slot, and the length of said second linear slot is substantially between 0.2 and 0.3.

11. The micro strip antenna of claim 1, wherein the width of said slot structure is substantially between 0.3 mm and 1.1mm.

12. The microstrip antenna of claim 1, wherein said base board is a printed circuit board.

13. The microstrip antenna of claim 1, wherein said base board is made of glass fiber material.

14. The microstrip antenna of claim 1, further having:

a feed point located at a position below a connection end between said L-shaped slot and said T-shaped slot, wherein said feed point is adjacent to one side of said microstrip patch radiator.

15. The microstrip antenna comprising:

a base board having a first surface and a second surface, wherein said first surface is parallel to said second surface; and a micro strip patch radiator having an arc shape, wherein said micro strip patch radiator is formed on said first surface of said base board, and has said slot structure exposing a portion of said base board, said slot structure having:

a substantial T-shaped slot composed of a first arc slot and a second arc slot, wherein said first arc slot is substantially vertical to a side of said microstrip patch radiator, and vertically connects said side to a middle position of said second arc slot;

a first hook-shaped slot, wherein one end of said first hook-shaped slot is vertically connected to one end of said second arc slot, and the opening direction of said first hook-shaped slot faces towards said first arc slot; and a second hook-shaped slot, wherein one end of said second hook-shaped slot is vertically connected to the other end of said second arc slot, and the opening direction of said second hook-shaped slot faces towards said first arc slot.

16. The microstrip antenna of claim 15, further comprising:

a ground plane located on said second surface of said base board.

17. The microstrip antenna of claim 16, further having:

a short point located on said microstrip patch radiator inside the hook shape of said first hook-shaped slot or said second hook-shaped slot, wherein said short point is electrically connected to said ground plane through said base board.

18. The microstrip antenna of claim 16, wherein said micro strip patch radiator and said ground plane are made of metal material.

19. The microstrip antenna of claim 16, wherein said first hook-shaped slot and said second hook-shaped slot are mirror-reflected to each other.

20. The microstrip antenna of claim 15, wherein said base board is a printed circuit board.

21. The microstrip antenna of claim 15, further having:

a feed point located on the same side with said first hook-shaped slot with respect to said substantial T-shaped slot, wherein said feed point is adjacent to one side of said microstrip patch radiator.

* * * * *